US008347445B2

(12) United States Patent
Park

(10) Patent No.: US 8,347,445 B2
(45) Date of Patent: Jan. 8, 2013

(54) REMOTE CONTROLLED ROBOT FOR CLEANING INNER-WALLS OF DUCT AND REMOTE CONTROL SYSTEM USING SAME

(75) Inventor: Byung Wook Park, Gyeonggi-do (KR)

(73) Assignee: IBS Engineering Co., Ltd., Seoul (KR)

( * ) Notice: Subject to any disclaimer, the term of this patent is extended or adjusted under 35 U.S.C. 154(b) by 559 days.

(21) Appl. No.: 12/449,938

(22) PCT Filed: Jul. 27, 2009

(86) PCT No.: PCT/KR2009/004152

§ 371 (c)(1),
(2), (4) Date: Sep. 3, 2009

(87) PCT Pub. No.: WO2010/013916

PCT Pub. Date: Feb. 4, 2010

(65) Prior Publication Data

US 2011/0138550 A1 Jun. 16, 2011

(30) Foreign Application Priority Data

Jul. 29, 2008 (KR) ..... 10-2008-0074041
Jun. 18, 2009 (KR) ..... 10-2009-0054567

(51) Int. Cl.
*B08B 9/051* (2006.01)

(52) U.S. Cl. ..... 15/104.09; 15/104.05; 15/104.31

(58) Field of Classification Search ..... 15/104.05, 15/104.09, 104.12, 104.31
See application file for complete search history.

(56) References Cited

U.S. PATENT DOCUMENTS 3,800,358 A * 4/1974 Ryan ..... 15/312.1
5,377,381 A * 1/1995 Wilson ..... 15/304
5,416,944 A * 5/1995 Eriksson ..... 15/104.09
5,528,789 A * 6/1996 Rostamo ..... 15/104.12

FOREIGN PATENT DOCUMENTS

JP 1-121187 * 5/1989
JP 8-91210 * 4/1996
JP 8-323309 * 12/1996
JP 2006-005666 1/2006
KR 10-188517 1/1999
KR 10-540450 12/2005

* cited by examiner

*Primary Examiner* — Mark Spisich
(74) *Attorney, Agent, or Firm* — Kusner & Jaffe

(57) ABSTRACT

The present invention relates to a remote controlled robot for cleaning inner walls of a duct, more specifically, to a remote controlled robot comprising: a cart movable in the duct by remote control; at least one first link pivotally connected to the cart, which is relatively rotatable to the cart; a first driving unit to drive the first link to relatively rotate to the cart; at least one second link pivotally connected to the first link, which is relatively rotatable to the first link; a second driving unit to drive the second link to relatively rotate to the first link; and a cleaning means installed at the second link for separating dusts from the inner walls of the duct, thereby enabling to clean the upper inner-walls and the bottom inner-wall of the duct simultaneously, and to continuously proceed with the cleaning in case of the height change of the duct to reduce cleaning time thereof.

3 Claims, 14 Drawing Sheets

REMOTE CONTROLLED ROBOT FOR CLEANING INNER-WALLS OF DUCT AND REMOTE CONTROL SYSTEM USING SAME

FIELD OF THE INVENTION

The present invention relates to a remote controlled robot and a control system for cleaning inner-walls of a duct, more particularly, to a remote controlled robot and a control system for effectively cleaning side walls, ceiling wall and bottom wall of a duct in spite of the slope change of the duct and for easily checking the cleaning state of a duct in real-time as well as after cleaning process, thereby enhancing the cleaning state of the duct as well as reducing cleaning time.

DESCRIPTION OF THE RELATED ART

In order to maintain indoor temperature in buildings within proper ranges regardless of the outdoor temperature, air-conditioning equipments are widely installed in most buildings. Also, ducts are connected to various locations from the air-conditioning equipments so as to circulate the air-conditioned air throughout the building.

As time goes by, dusts, dirt, fungi, etc. (hereinafter in specification and in claims, simply referred to as 'dusts') become accumulated on the inner-walls of the ducts, and thus the air-conditioned but contaminated air due to dusts during supplying through a duct causes human beings in a building to get respiratory infections such as asthma, bronchitis. Also, the dusts from the ducts also make troubles to electric devices in the building such as computers. Further, the air-conditioning efficiency gets lowered when lots of dusts are stuck on the inner-walls of the ducts. Therefore it is necessary to periodically remove and clean dusts completely from ducts.

However, as the inside of ducts is too narrow for a worker to go inside and further the ducts are not supported enough to support the weight of the worker, it is only possible to clean the inside of the ducts by using a remote controlled cleaning robot.

Conventional cleaning robots clean inner-walls of ducts by rotating brushes of which diameter corresponds to the height of the duct. Therefore, when the height of duct is changed, the brushes should be exchanged to fit the changed height of the duct and thus it takes long time to clean ducts. Alternatively, it would be possible for the conventional cleaning robot to use smaller brushes, however, it would cause much longer time to clean each wall of ducts respectively, for example, in sequence of either wall, ceiling wall and bottom wall.

Most of all, as the brushes are fixed at one position of the conventional cleaning robot, when the conventional cleaning robot cleans the upward or downward sloped region of ducts, some parts could not be brushed and thus there is a limit that all inner-walls cannot be cleaned by the conventional cleaning robot.

Accordingly, it is highly required to clean every corner of inside and inner wall of ducts within a short time.

Meanwhile, conventional cleaning robot has its brushes at a fixed height, the cleaning enterprise requires two kinds of robots, i.e., for cleaning low-height ducts and for cleaning high-height ducts so as to clean ducts of diverse heights.

Further, as a conventional cleaning robot hires the only brushes to remove dusts from the inner walls of ducts, it is necessary to install a dust collector to gather dusts separated from the inner walls of ducts and to remove from the interior of ducts. However, it is troublesome to install the dust remover at ducts after cleaning the interior of ducts by a cleaning robot.

In the meantime, although the interior of ducts may be more reliably and completely cleaned when using a conventional cleaning robot than using hands of workers, there is no way to check the cleaning state throughout the interior of ducts after the cleaning.

Sometimes, a cleaning enterprise photographs the part of ducts to prove the completeness of cleaning. However, the photos of sample parts cannot guarantee the cleaning state of the whole area. Thus, the owner of a building is not willing to trust a cleaning enterprise and will not clean the interior of ducts in the building, and therefore, it has been serious problem that people in the building are still exposed to contaminated air-conditioned air.

DETAILED DESCRIPTION OF THE INVENTION

Objects of the Invention

These disadvantages of the prior art are overcome by the present invention. It is an object of the present invention to provide a remote controlled robot to simultaneously clean ceiling wall, bottom wall and side walls of ducts at any position in ducts and to be capable of cleaning every corner completely, even when the height of ducts or the slope of ducts is varied.

Also, it is an object of the present invention to provide a remote controlled robot to be capable of adjusting the length of links by combining more than two segmented links, thereby being capable of cleaning ducts of diverse heights with a single cleaning robot.

Further, it is another object of the present invention to provide a remote controlled robot to take images to help control of the robot and to check the cleaning state with at least one camera without being hindered by the cleaning means.

Yet, it is an object of the present invention to provide a remote controlled robot to separate dusts from the inner walls of ducts and simultaneously to remove dusts by sucking from the interior of ducts, thereby completing the cleaning of ducts with one pass of the robot.

And, it is an object of the present invention to provide a remote controlled robot to enable to remove dusts (e.g., chemical dusts which is harmful to human) from the inside of a chemical duct without causing the chemical dusts harmful to human beings to be spread into nearby.

Further, it is an object of the present invention to provide a remote controlled robot to enable to effectively clean inner walls of ducts without damaging the inner.

Also, it is an object of the present invention to provide a remote controlled robot cleaning system to easily verify the cleaning state of ducts on-time to enable to clean corner to corner or after cleaning to enable an operator of the robot to check the interior of the ducts corner to corner.

Therefore, it is another object that the owner of a building can simply check the cleaning state throughout the whole interior of ducts so that the owner will not hesitate to clean the interior of ducts owing to distrust of the cleaning state thereof, thereby prompting to clean ducts and thus solving the problem that people in the building is exposed to breathe dirt air-conditioned air contaminated in ducts.

Also, it is an object that an operator to control a cleaning robot is able to visually check the cleaning state on-time and thus to clean the interior of ducts more completely.

Further, it is an object that a cleaning robot can freely move along ducts without getting lost in the dark and complex ducts.

BRIEF DESCRIPTION OF THE INVENTION

Construction of the Invention

In order to attain the above mentioned object, the present invention provides a remote controlled robot for cleaning the inner walls of a duct, which comprises: a cart movable in the duct by remote control; at least one first link pivotally connected to the cart, which is relatively rotatable to the cart; a first driving unit to drive the first link to relatively rotate to the cart; at least one second link pivotally connected to the first link, which is relatively rotatable to the first link; a second driving unit to drive the second link to relatively rotate to the first link; and a cleaning means installed at the second link for separating dusts from the inner walls of the duct.

That is, as the first link having the cleaning means is pivotally connected to the cart which is remotely controlled, even when ducts has irregular sloped path, the cleaning means can simultaneously clean bottom wall, ceiling wall and either side wall thereby promptly cleaning the interior of ducts more cleanly within a short time by controlling the second links.

More specifically, conventional cleaning robot can only be able to clean the restricted region by a cleaning means thereof, the cleaning robot of the present invention can clean the extended area which is lower than wheels of the cleaning robot, because the cleaning means thereof of located on the second link which is relatively rotatable to the first link and the first link is pivotally connected and thus relatively rotatable to the cart. Therefore, when the slope of ducts varies steeply downwards, as the first link can rotate downwards and thus the bottom end of the second link can contact the bottom wall of ducts having a downward slope, the cleaning robot of the present invention can clean downward sloped bottom walls of ducts. Similarly, when the slope of ducts varies steeply upwards, as the first link can rotate that the free end of the first link can be located horizontally or higher to the cart and thus the upper end of the second link can contact the ceiling wall of ducts having a upward slope, the cleaning robot of the present invention can clean upward sloped ceiling walls of ducts.

Herein, the first driving unit and the second driving unit can be formed as an air motor operated by compressed air or an electric motor respectively, or can be formed as a hydraulic cylinder or electric cylinder to rotate the first link and the second link respectively. In case that the first driving unit is formed as a hydraulic cylinder or electric cylinder, by pivotally fixing the end of the cylinder to the cart and also pivotally fixing the other end of the cylinder to the first link, and then by elongating or contracting the length of the cylinder, the first link can be relatively rotated to the cart. Similarly, in case that the second driving unit is formed as a hydraulic cylinder or electric cylinder, by pivotally fixing the end of the cylinder to the first link and also pivotally fixing the other end of the cylinder to the second link, and then by elongating or contracting the length of the cylinder, the second link can be relatively rotated to the first link. However, it is more efficient to apply the air motor or electric motor to the first driving unit and to the second driving unit. The first driving unit and the second driving unit as well as driving unit of the cleaning means can be formed as other means which are not described above.

Also, in case that the cleaning robot of the present invention passes the region where height of ducts can change, the cleaning robot can contact or approach the end of the second link with the cleaning means up to the ceiling wall or down to the bottom wall by changing the relative angle of the second link to the first link, thereby enabling to clean the interior of ducts efficiently within a short time without stopping during cleaning process.

Therefore, as the first link is installed to relatively rotate to the cart, the cleaning robot of the present invention has advantageous effects that the either end of the second link can easily contact or approach up to the ceiling wall even in upward sloped regions or down to the bottom wall even in downward sloped regions, and thus be able to clean every wall of ducts without stopping of the cleaning process.

Herein, it is desirable that the second links are formed as a pair, each of which is apart from each other in the traverse direction. Further, the pair of second links are connected by connecting member to reinforce the structural stability.

Under this construction, the cleaning means of the present invention is arrayed the top area between the one end of the second links, the bottom area between the other end of the second links, and the side areas along the outer surface of the second links, and thus, the cleaning means is simultaneously contacted or approached to the ceiling wall and the bottom wall with extensive cleaning contact area.

Most of all, when the pair of second links are formed apart from each other in the traverse direction, it is much easier to control the cleaning robot in ducts. Concretely, it is required to have at least one camera and an illuminator to watch the interior of ducts for controlling the movement of the cleaning robot and checking the cleaning state of the interior of ducts. However, if the cleaning means such as brushes for cleaning ceiling, bottom and side walls is fixed to one link, the cleaning means such as brushes covers the sight of the cleaning robot, it will be much difficult to control the movement of the cleaning robot, and thus the robot could not find the sloped or dug region in advance so might be dropped from the interior of ducts with losing its balance during cleaning process, or the robot might damage any device in ducts such as temperature sensor or flow rate sensor protruded on the inner walls of ducts.

Therefore, when the pair of second links are arrayed apart from each other in the traverse direction in accordance with the present invention, and when the cleaning means is arrayed in both ends area between the second links, as a rectangular empty space is formed surrounded by the cleaning means, the cleaning robot of the present invention can obtain front sight through the rectangular empty space with a front camera and an front illuminator. Herein, the front camera and the front illuminator are formed as rotatable in the horizontal direction and obtain front-right views and front-left views.

On the other hand, a cleaning robot can clean inner walls of ducts completely only when a cleaning means contacts or approaches to the ceiling or bottom wall of ducts. However, the heights of ducts are quite different from one another in accordance with the usage of ducts or the type of buildings. Accordingly, these various ducts have been cleaned by using different cleaning robots, each of which has brushes of different diameter installed at different height fit for the height of ducts. However, it costs too much for many cleaning enterprises to set up diverse cleaning robots fit for each height of ducts, and it has taken too longer time owing to exchange of the cleaning robots of different height in accordance with the region of a duct. Therefore, the cleaning robot of the present invention controls the length of the second links by forming the second links to be connected with more than two segmented links, and thus, regardless of the height change of a duct, the whole interior of ducts can be cleaned with only one cleaning robot of the present invention.

Also, the cleaning means includes brushes at least one area along the outer sides of the second links and/or between the both ends of the second links, whereby the dusts stuck on inner walls can be removed by mechanical contact with the brushes.

Herein, the cleaning means includes slits or nozzles at the second link to blow compressed air to inner walls, of which slits or nozzle is connected via air passages to supply the compressed air, whereby the inner walls of ducts are cleaned by the compressed air in case that the inner walls should not be contacted with the cleaning means.

Also, the cleaning means includes suction means in addition to the above described brushes or slit nozzles thereby enabling to collect dusts from inside of ducts without causing dusts to be filled inside of ducts, and to collect dusts immediately after separating dusts from the inner walls by brushes and/or compressed air.

Further, the cleaning means includes suction means to collect dusts together with brushes to remove dusts stuck on the inner walls at the suction opening of the suction means, whereby removing and collection process during the cleaning process can be realized at one time.

On the other hand, the present invention provides a remote controlled robot cleaning system for cleaning the inner walls of a duct, which comprises: a remote controlled robot including a cart movable in the duct, a cleaning means for removing dusts from the inner walls of the duct at least one link relatively rotatable to the cart, a front camera facing forwards from the cart, and a rear camera facing backwards from the cart; a control unit of remotely controlling the movement of the cart and the relative rotation of the link to the cart; and a display unit of simultaneously displaying the front images captured by the front camera and the rear images captured by the rear camera in at least two divided screens; wherein the cleaning state of the duct can be checked by comparing the front images before cleaning with the rear images after cleaning.

That is, while the cleaning robot cleans and moves in ducts, the operator can check the cleaning state of the interior of ducts in real-time by photographing front unclean views of the cleaning robot by the front camera and photographing rear cleaned views of the cleaning robot by the rear camera and thus, can clean inside of ducts more completely based on the captured photographed views by the front camera.

The remote controlled robot cleaning system of the present invention further comprises a storage unit of storing the image data displayed by the display unit. Therefore, the cleaning state photographed by the front camera, having viewed by the display unit and stored in any storage medium by the storage unit can be also checked by anyone in addition to the operator after the cleaning process. Herein, the storage medium can be a video tape recording at least one of the front unclean moving images photographed by the front camera or the rear cleaned moving images photographed by the rear camera and also can be one of CD, DVD, USB memory, hard disk, etc. recording preferably to simultaneously check both the front images before cleaning and the rear images after cleaning. Herein, the stored images can be played in form of still images or moving film. Also, regardless of the type of medium, the front images before cleaning and the rear images after cleaning can be simultaneously displayed so as to easily check how well the interior of ducts has been cleaned.

That is, although the customer of cleaning ducts could only check the cleaning state based on several distrustful photos provided by the cleaning enterprise, the present invention realizes to check the cleaning state of entire interior of ducts in real-time or after cleaning process based on the still or moving images before and after cleaning captured by the front camera and the rear camera, whereby the cleaning state of ducts can be scrupulously and easily examined based on whole trustful images throughout the entire ducts.

Therefore, the cleaning enterprise using the present invention can get more trust from the customers, i.e., owners of buildings, and the owners of building become willing to clean ducts of their building with trust, whereby people in various buildings will not breathe contaminated air-conditioned air any more.

In the mean time, the position of the cleaning robot in ducts is sensed and the display unit displays the position of the cleaning robot on the layout of the duct in the divided screen. That is, the position of the cleaning robot can be obtained by sensing a position sensor attached thereto or can be obtained by sensing the rotation number of a driving motor of the cart and then calculating inversely from the initial position. Then, as the position of the cleaning robot is indicated on the layout of ducts, an operator is able to easily move the cleaning robot without a collision against walls in spite of dark and complex ducts.

Also, the cleaning robot of the present invention further comprises a second camera to photograph views of area being cleaned by the cleaning means, and then displays the views being cleaned in the divided screen, and thus, an operator can check the cleaning state of which area is being cleaned by the cleaning means and then decide to advance the cleaning robot or stay more based on the cleaning views displayed in the divided screen.

Further, the present invention provides a storage medium such as CD, DVD, hard disk, USB memory and video tape which can selectively and simultaneously display the front view before cleaning and the rear view after cleaning of the inside of ducts.

Also, the present invention provides a remote control system of duct cleaning robot which includes a cart movable in the duct by remote control, a cleaning means for removing dusts from the inner walls of the duct installed at a pair of links relatively rotatable to the cart, a front camera to face forwards from the cart, and a rear camera to face backwards from the cart, comprising: a control unit for remotely controlling the movement of the cart and the rotation of the pair of links; and a display unit for simultaneously displaying front unclean inner-duct images captured by the front camera while proceeding with cleaning a duct and rear cleaned inner-duct images captured by a rear camera while proceeding with cleaning the duct in at least two divided screens, whereby operator can check the cleaning state of the interior of ducts in real-time and control the cleaning robot to clean completely every corner to corner.

Advantageous Effect

The present invention provides a remotely controlled cleaning robot to shorten the whole cleaning time by simultaneously contacting or approaching to the ceiling wall, the bottom wall and either side wall for cleaning, and further to clean corner to corner without stopping even when the cleaning robot passes upward sloped regions or downward sloped regions of a duct.

Also, the present invention enables to adjust the length of the distribution of a cleaning means such as brushes by changing the number of segmented links and the length thereof in accordance with the shape of ducts to be cleaned, in that the cleaning means is arrayed around the pair of second links and that the second links are formed by connecting more than two segmented links, whereby diverse ducts can be cleaned by one cleaning robot.

Further, the cleaning robot in accordance with the present invention can view the front region of a duct through a rectangular empty space surrounded by the cleaning means without being covered by a cleaning means such as brushes.

And, the present invention achieves to remove and collect dusts at one time within a short time without causing dusts to flow around in the ducts and without requiring a dust collector, in that the cleaning means includes suction means to collect dusts together with brushes to remove dusts stuck on the inner walls at the suction opening of the suction means.

Also, the present invention more easily cleans the inner walls when the cleaning robot moves along sloped region of a duct, because the opening of a suction means always faces ceiling wall or bottom wall.

On the other hand, the present invention enables for an operator to proceed with the cleaning process with checking and comparing the front view before cleaning and the rear view after cleaning in real-time, entire wall of ducts can be cleaned corner to corner without any region where cleaning has not been done.

Further, the present invention enables anyone to carefully check the final cleaning state of ducts as if the cleaning process were being done, by simultaneously watching images before cleaning (i.e., front images photographed by the front camera) and images after cleaning (i.e., rear images photographed by the rear camera) on the divided screen stored during the cleaning process in a storage medium such as hard disk, USB memory, CD, DVD, video tape.

Therefore, the present invention psychologically forces a cleaning enterprise to clean entire inside of ducts corner to corner instead of cleaning some regions more completely where anyone easily checks the cleaning state, whereby people in a building will not breathe contaminated air-conditioned air.

The present invention also enables an operator to easily control the cleaning robot's movement without a collision against walls in dark and complex ducts because the position of the cleaning robot in ducts is sensed and the display unit displays the position of the cleaning robot on the layout of the duct in real-time in the divided screen.

Embodiments

BRIEF DESCRIPTION OF THE DRAWINGS

Accordingly, the present invention will be understood best through consideration of, and reference to, the following Figures, viewed in conjunction with the Detailed Description of the Preferred Embodiment referring thereto, in which like reference numbers throughout the various Figures designate like structure and in which.

DETAILED DESCRIPTION OF PREFERRED EMBODIMENTS

Figure 1:
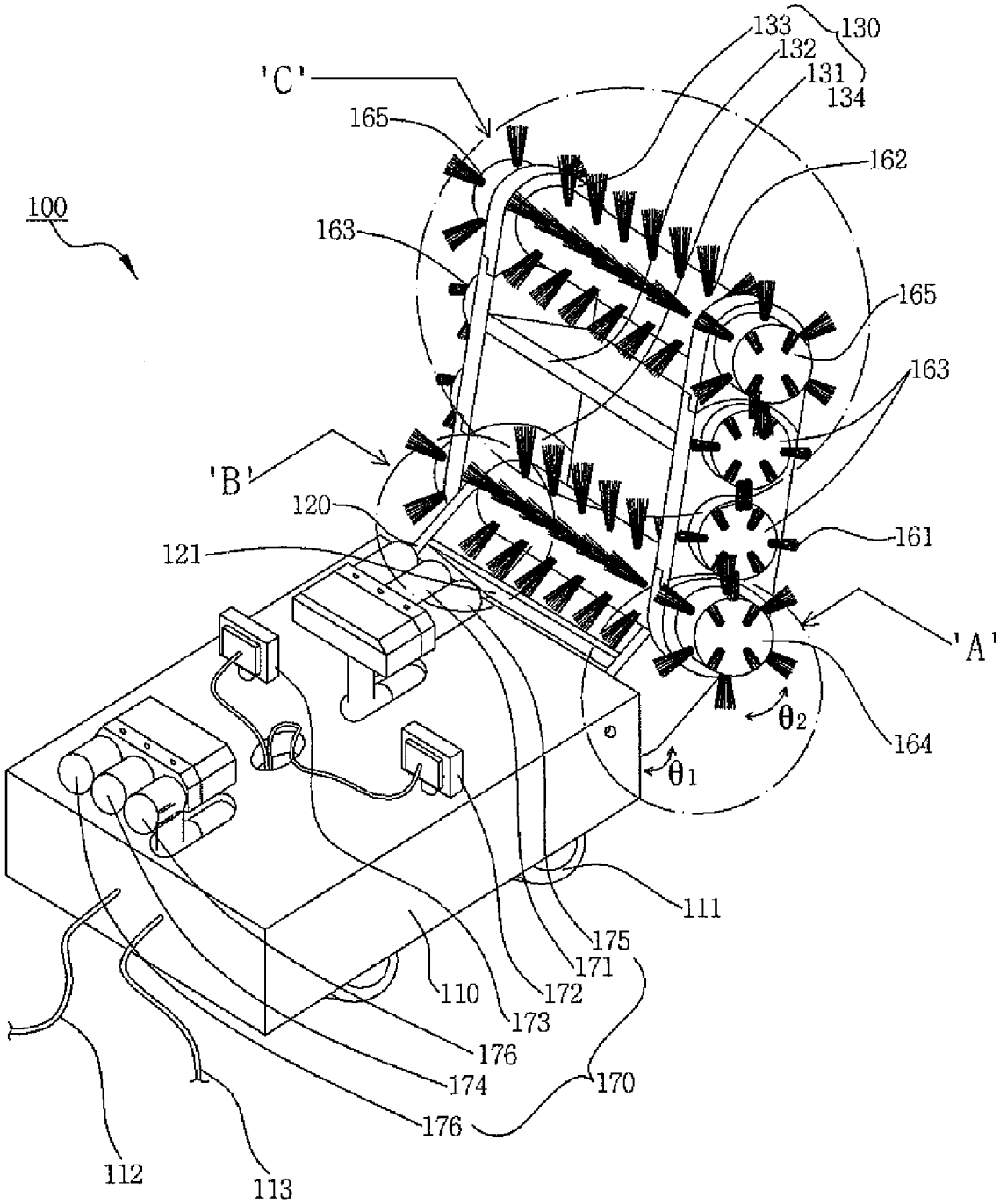
FIG. 1 is a perspective view illustrating a remote controlled robot for cleaning inner walls of duct of a first embodiment in accordance with the present invention.

The foregoing and other objects, features, aspects and advantages of the present invention will become more apparent from the following detailed description of the present invention when taken in conjunction with the accompanying drawings.

In describing the present invention, detailed description of laid-out function or structure is omitted in order to clarify the gist of the present invention.

As illustrated in FIGS. 1 to 7, the remote controlled robot 100 for cleaning inner walls of ducts of a first embodiment in accordance with the present invention comprises a cart 110 which moves inside of a duct 88 in any direction by remote control, a pair of first links 120 relatively rotatable to the cart 110 at front part of the cart 110, a pair of second links 130 relatively rotatable to the pair of the first links 120, a first driving unit 140 for driving the first links to relatively rotate to the cart 110, a second driving unit 150 for driving the second links 130 to relatively rotate to the first links 120 respectively, a cleaning means 160 formed as brushes arrayed at area of the outer sides of the second links 130 and at area between both ends of the second links 130 for separating dusts from inner walls of duct 88, a camera unit 170 for photographing the inside of ducts 88 during the movement of the cart 110, and a cleaning means driving unit 180 for making the brushes of the cleaning means 160 rotate.

The cart 110 includes a steering device to turn left and right, wheels 111 to move forwards and backwards, power cables 112 to supply electric power to cart 110 and the camera unit 170, signal cables 113 to transfer captured image data and driving signals, and at least one motor to move the cart 110.

The first links 120 are pivotally installed at the front part of the cart 110 to be driven to rotate in back and forth directions by the first driving unit 140, and can relatively rotate to the cart 110 so that their ends reach down below the wheels 111. As the first links 120 are formed as a pair each of which is arrayed apart from each other in the transverse direction, a connection link 121 connects both the first links 120 in order to obtain structural stability of the first links 120.

The second links 130 are pivotally connected with the first links 120 respectively and are controlled to relatively rotate to the first links 120 so that the brushes 161-165 rotatably installed at both ends of the second links 130 can contact with the ceiling wall as well as the bottom wall. As the second links 130 are also formed as a pair each of which is arrayed apart from each other in the transverse direction, a connection link 134 connects both the second links 130 in order to obtain structural stability of the second links 130. However, the location of the connection link 134 is decided at a place where the connection link 134 does not hinder camera unit 170 to view forwards through the rectangular empty space surrounded by the cleaning means 160 and the second links 130.

Figure 3:
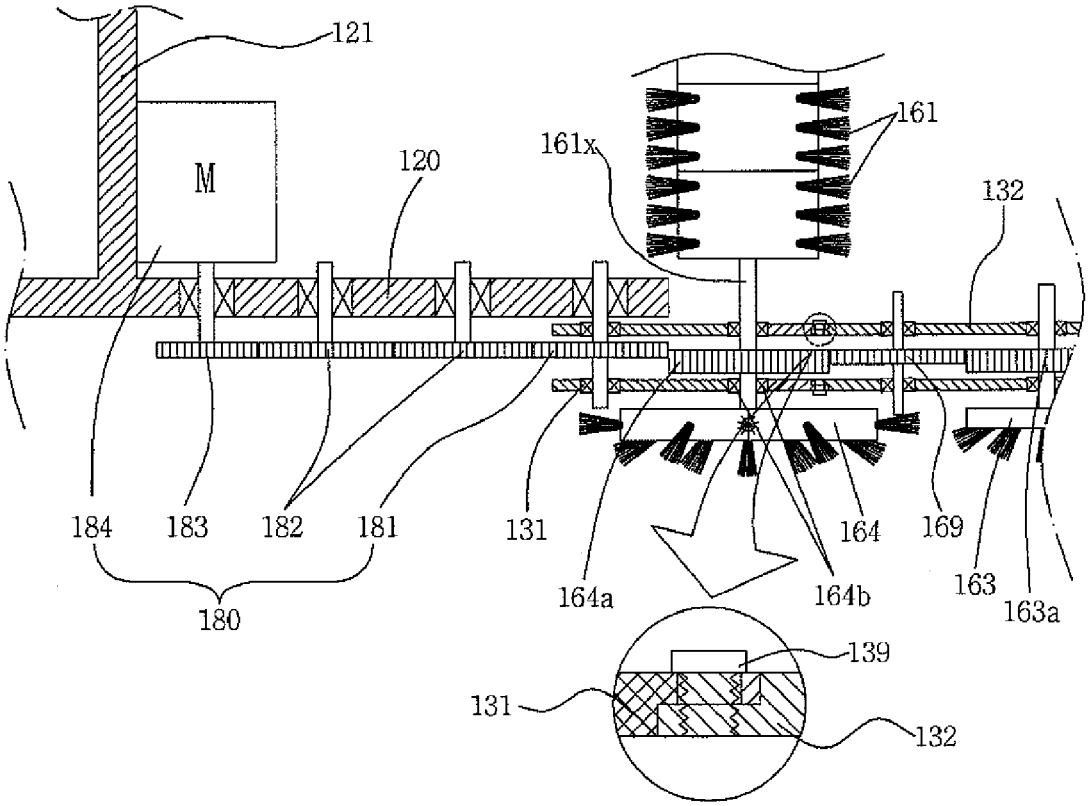
FIG. 3 is a cross sectional view by a cut line of FIG. 2
Figure 7:
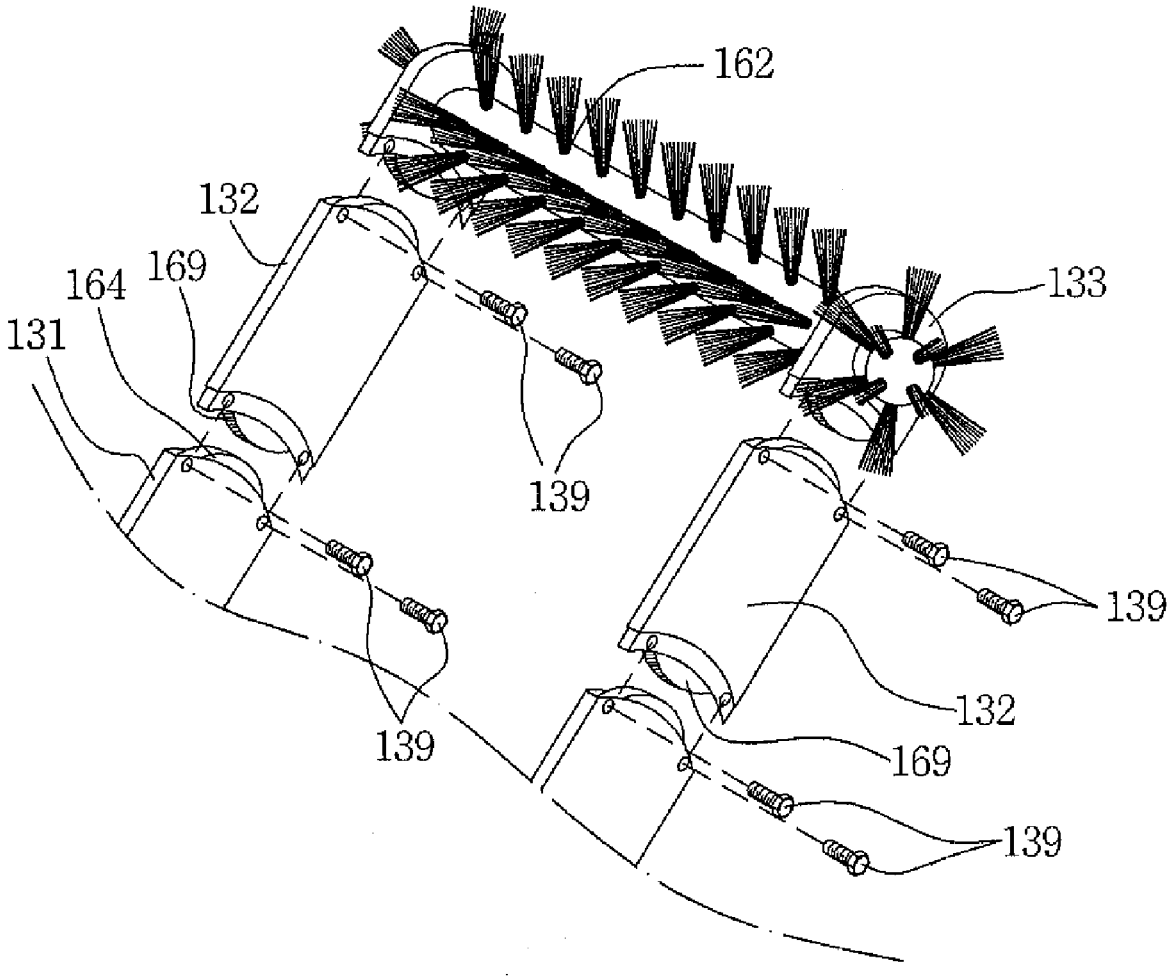
FIG. 7 is a perspective view of a dissembled construction of the second links in FIG. 1.

Although the second links 130 are formed as a member, as shown in FIGS. 3 and 7, the second links 130 is formed by combining a plurality of segmented links 131, 132, 133 with fastening means such as bolts 139 whereby the length of the second links 130 can be adjusted to the height H of ducts 88. Herein, the first embodiment of the present invention exemplifies that each of the second links 130 is formed by combining three segmented links 131-133, however, each of the second links 130 can be formed by combining more than three segmented links, and further, the central segmented links 132 can be selected to fit the combined second link 130 to the height H of ducts 88. Therefore, the cleaning robot 100 of the first embodiment of the present invention can clean diverse ducts having different heights with only one cleaning robot.

Figure 2:
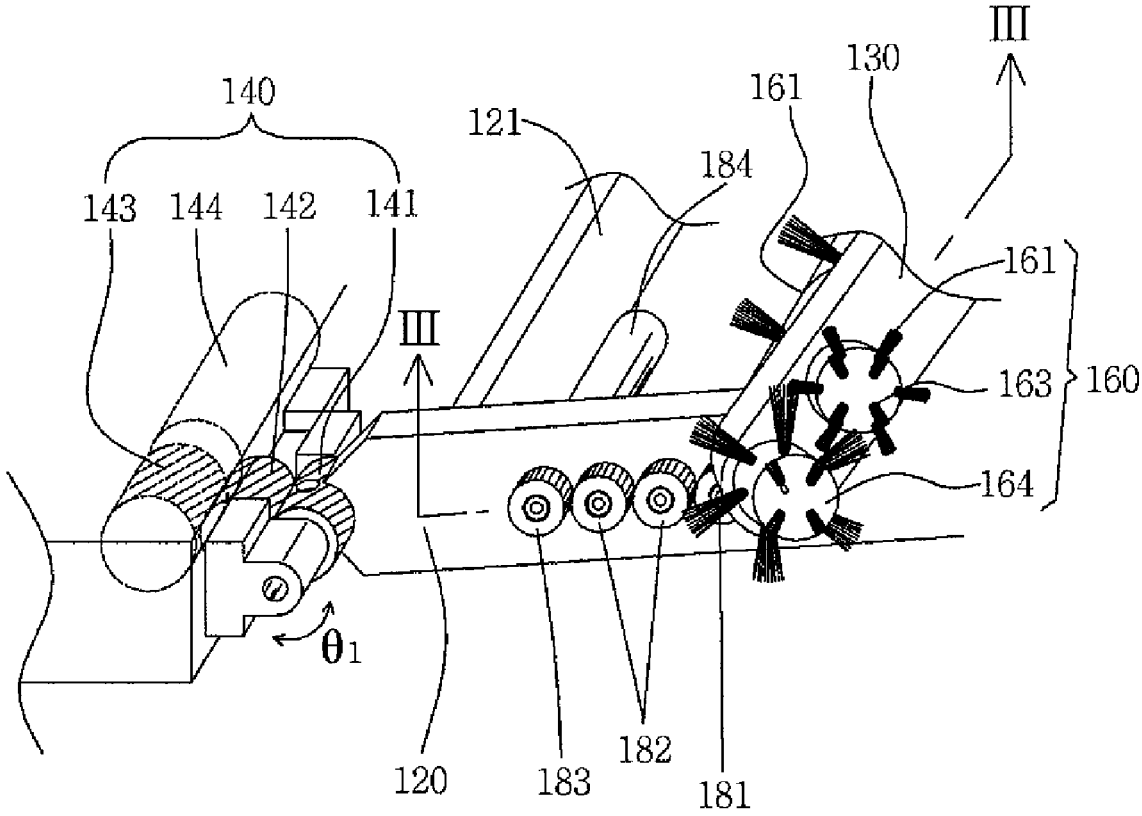
FIG. 2 is an enlarged perspective view of 'A' in FIG. 1.

As illustrated in FIG. 2, the first driving unit 140 is installed at one side of the pair of the first links 120, and includes a driven gear 141 integrally rotating with the first links 120, a connection gear 142 rotatably installed at the front part of the cart 110 in engaged with the driven gear 141, a pinion 143 to drive the connection gear 142 to rotate, a first driving motor 144 to drive the pinion 143 to rotate. Thus, when the first driving motor 144 rotates, the pinion 143, the connection gear 142 and the driven gear 141 rotate sequentially, and thus the first links 120 relatively rotate to the cart 110 in forward and reverse directions.

Figure 4:
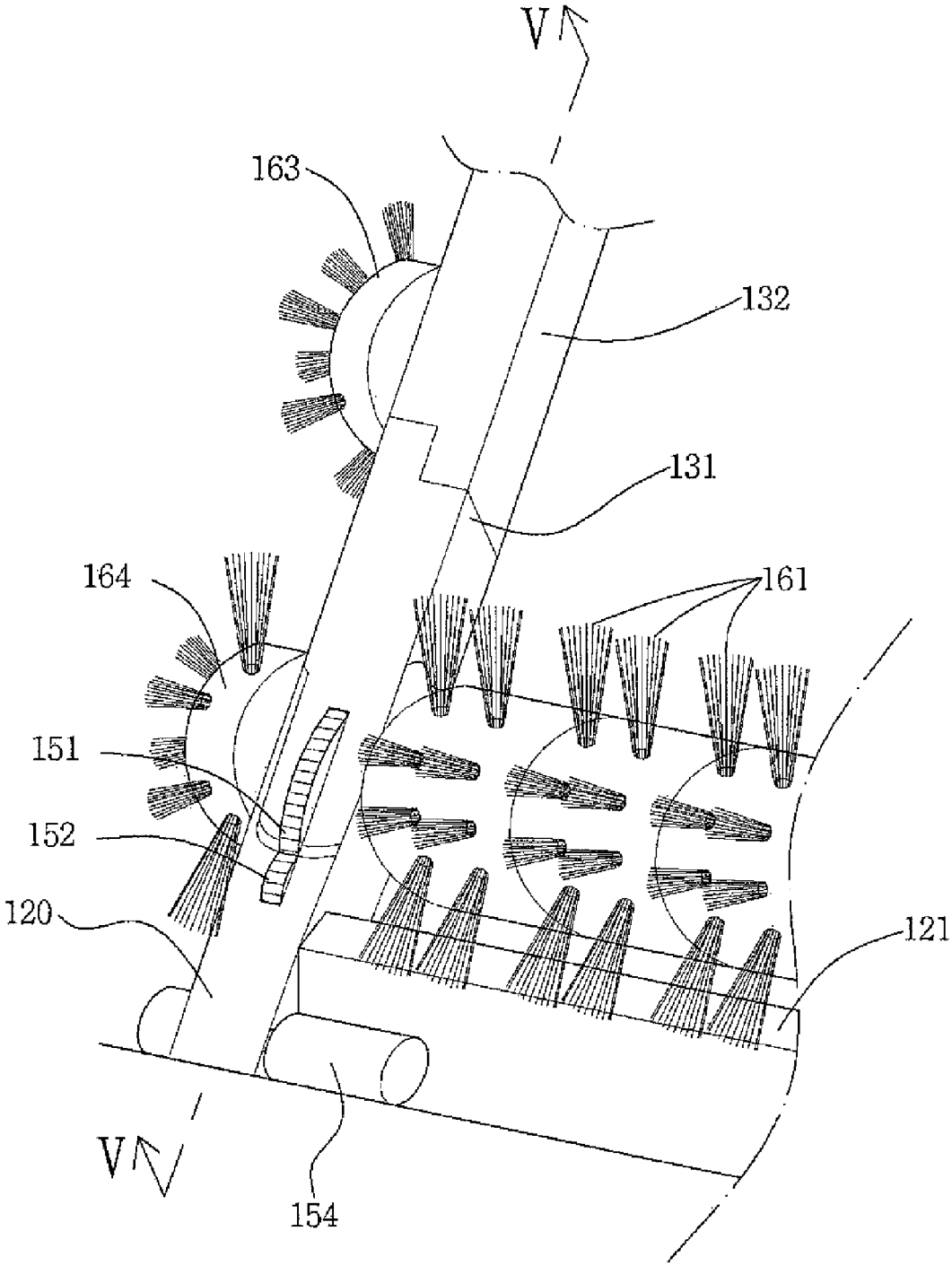
FIG. 4 is an enlarged perspective view of 'B' in FIG. 1.
Figure 5:
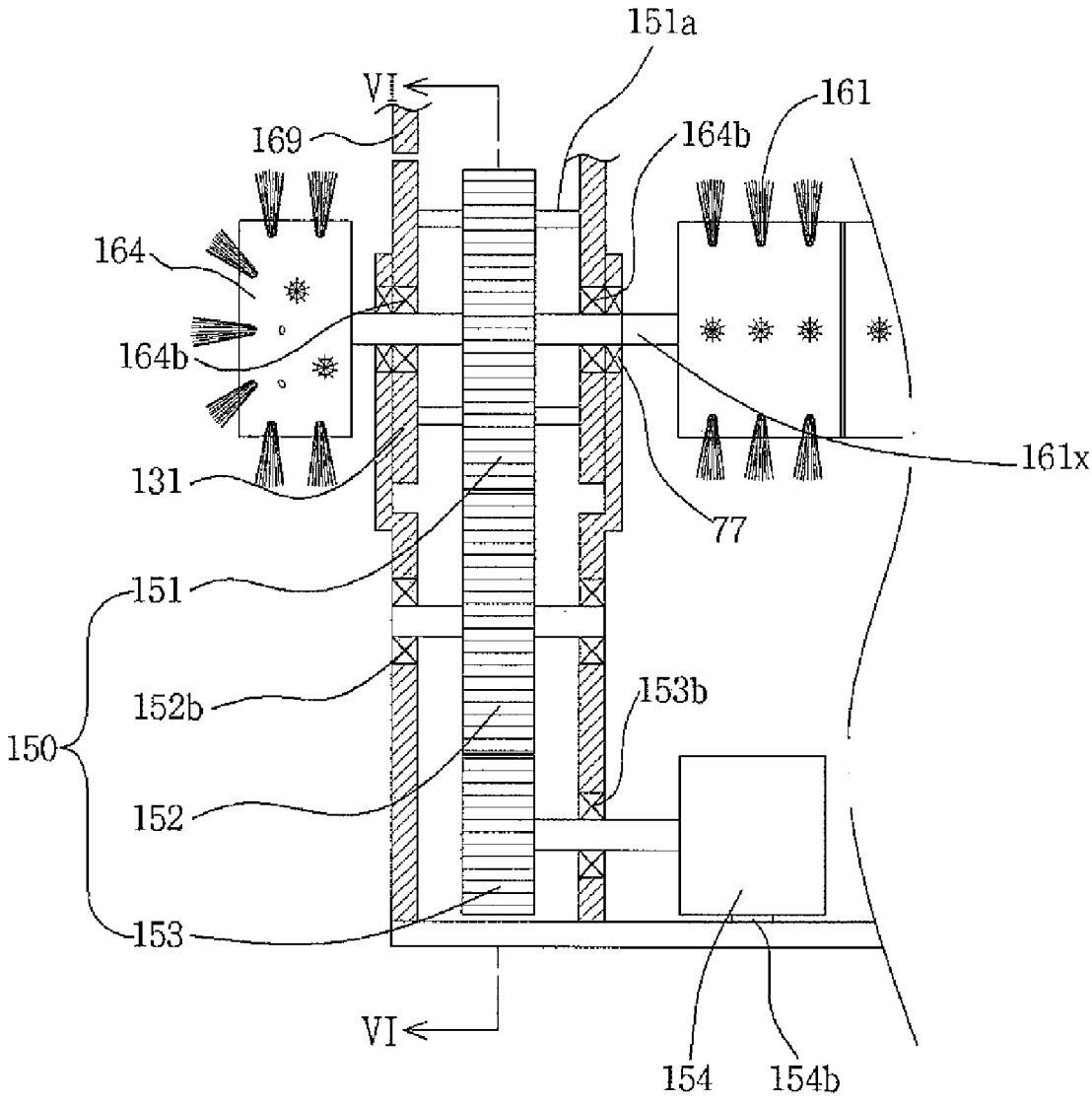
FIG. 5 is a cross sectional view by a cut line V-V of FIG. 2

As illustrated in FIGS. 4 and 5, the second driving unit 150 is installed at the other side of the pair of the first links 120. Also, the second driving unit 150 includes a driven gear 151 integrally combined with the second links 130 by a pin 151*a*, a connection gear 152 rotatably installed in one first link 120 in engaged with the driven gear 151, a pinion 153 to drive the connection gear 152 to rotate, a second driving motor 154 installed on a mounting plate 154*b* fixed to the first link 120 so as to drive the pinion 153 to rotate. Herein, the connection gear 152 and pinion 153 are rotatably supported by bearings 152*b*, 153*b* in order to rotate in the first link 120. Also, the second links 130 are connected via hinge pin 77 with the first links 120 so that the second links 130 can relatively rotate to the first links 120.

Figure 6:
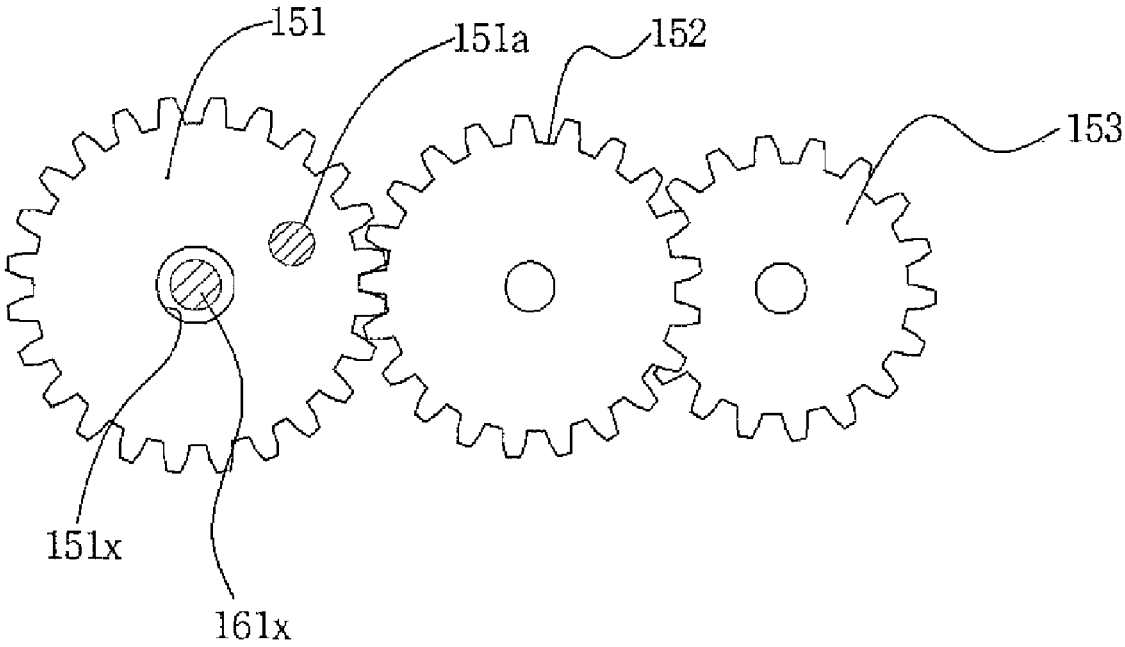
FIG. 6 is a cross sectional view by a cut line VI-VI of FIG. 5

As illustrated in FIG. 6, regardless of the rotation of bottom brushes 161 to clean the bottom wall of ducts 88, in order for the second links 130 to relatively rotate to the first links 120, a penetrating hole 151*x* is formed at the center of the driven gear 151 of the second driving unit 150. And a rotating shaft 161*x* of the bottom brushes 161 passes through the penetrating hole 151*x*. The rotating shaft 161*x* of the bottom brushes 161 is rotatably supported by bearings 164*b* at the ends of the pair of the second links 130, the rotation of the bottom brushes 161 can be rotatably controlled regardless of the relative rotation of the second links 130 to the first links 120.

The cleaning means 160 includes the bottom brushes 161 rotatably arrayed at lower area between connecting ends of the second links 130 with the first links 120, ceiling brushes 162 rotatably arrayed at upper area between free ends of the second links 130, side brushes 163 rotatably arrayed on outer surface of the second links 130, bottom side brushes 164 rotatably arrayed on outer surface of the connecting ends of the second links 130 and ceiling side brushes 165 rotatably arrayed on outer surface of the free ends of the second links 130.

Herein, The bottom brushes 161 and the ceiling brushes 162 are extended vertically from the rotating shaft so that the bottom brushes 161 and the ceiling brushes 162 can reach bottom walls and ceiling walls of ducts 88. However, the side brushes 163 are extended slant from their rotating shaft to the side walls of ducts 88 so as to reach side walls of ducts 88. On the other hand, the bottom side brushes 164 and the ceiling side brushes 165 are extended both in vertical and in slant so that clean the ceiling wall, bottom wall and side walls simultaneously.

Each of the brushes 161-165 are driven to rotate all together by a gear rotation.

The camera unit 170 includes a front camera 171 for photographing front unclean views of the cart 110 during the cleaning process, a right camera 172 and a left camera 173 for photographing right and left views of the cart 110 which is being cleaned by the cleaning means 160 during the cleaning process, a rear camera 174 for photographing cleaned rear views of the cart 110 during the cleaning process, a pair of front illuminators 175 to illuminate the front views of the cart 110 for helping the front camera 171 photograph, and a pair of rear illuminators 176 to illuminate the rear views of the cart 110 for helping the rear camera 174 photograph. The captured image data by the cameras 171-174 are sent via the signal cables 113 to a remote control system 500.

An operator controls the movement and cleaning process of the cleaning robot 100 in ducts 88 with viewing the images from the cameras 171-174 in real-time. Therefore, the operator visually check whether uncleaned regions are still searched in spite of having once cleaned with the cleaning means 160, and then cleans the searched uncleaned regions again until the uncleaned regions becomes clean, whereby every wall can be completely cleaned corner to corner in accordance with the present invention.

As illustrated in FIGS. 2 and 3, the cleaning means driving unit 180 includes a driving gear 181 engaged with the driven gear 164*a* which integrally rotates with the rotating shaft 161*x* connecting the bottom brushes 161 and the bottom side brushes 164, a plurality of connection gears 182, a pinion 183 engaged with one of the connection gears 182, and a brush driving motor 184 to drive the pinion 183 to rotate. Herein, one of the connection gears is engaged with the driving gear 181 in the first link 120.

Therefore, when the brush driving motor 184 rotates, the driving gear 182 is driving to rotate via the pinion 183 and a plurality of connection gears 182, and then the driven gear 164*a* also rotates in accordance with the rotation of the driving gear 182, and thus, the bottom brushes 161 and the bottom side brushes 164 are driven to rotate. As illustrated in FIG. 3, as the driving gear 181 is installed rotatable independently of the first links 120 and the second links 130, the brush driving motor 180 is not influenced by the relative rotation between the first links 120 and the second links 130.

Meanwhile, the rotating shaft 161*x* of the driven gear 164*a* which integrally rotates with the bottom brushes 161 and the bottom side brushes 164 is rotatably supported by bearings 164*b* at the second link 130. Also, connection gears 169 are installed in the second link 130 to be engaged with the driven gear 164*a* and one of gears 163*a* integrally rotating with the side brushes 163. Herein, the gears 163*a* are engaged with one another between which a connection gear (not shown) is placed in engage with neighboring gears 163*a*. Therefore, when the bottom brushes 161 and the bottom side brushes 164 rotates driven by the driven gear 164*a*, all side brushes 163 rotate all together via the connection gears 169.

Similarly, as illustrated in FIG. 7, the rotation shaft of the ceiling brushes 162 and the ceiling side brushes 165 is engaged with the connection gears 169 installed in the segmented center link 132 so that the ceiling brushes 162 in the area between the free ends of the second links 130 rotate with the bottom brushes 161. Also, although it is not illustrated in FIG. 3, the side brushes 163 on either second link 130 are also driven to rotate by being engaged with a gear which integrally rotates with the ceiling brushes 163.

Figure 8:
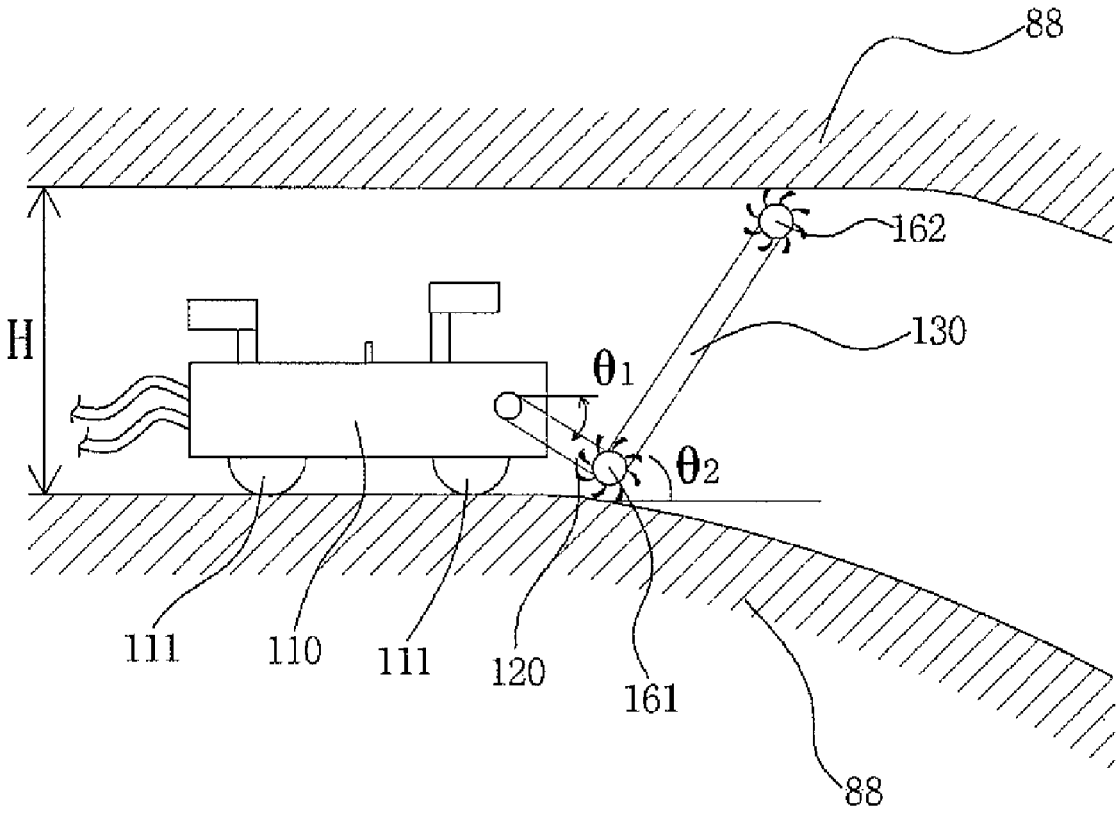
FIG. 8 is a schematic diagram illustrating the remote controlled robot which cleans the downward sloped region of the duct.

As illustrated in FIG. 8, the remote controlled robot 100 for cleaning ducts of the first embodiment of the present invention can make the bottom brushes at bottom area between connecting ends of the second links 130 contact with the bottom wall of the duct 88 and also simultaneously can make the ceiling brushes at top area between free ends of the second links 130 contact with the ceiling wall of a duct 88 during movement in a duct by controlling the angle of the first links 120 and the second links 130, even when the robot 100 passes through the downward sloped region or the upward sloped region, whereby the cleaning process can be promptly finished.

For example, as the first links 120 can be rotated upwards and downwards to the cart 110, in case that downward sloped region is to be cleaned by the cleaning robot 100, the first links 120 are driven to rotate downwards by theta 1 and the second links 130 are driven to rotate upwards by theta 2 from the horizontal line, and thus the cleaning unit 160 of the cleaning robot 100 can be simultaneously contacted with the ceiling wall and the bottom wall of the duct 88. Similarly, in case that upward sloped region is to be cleaned by the cleaning robot 100, the first links 120 are driven to rotate upwards and the second links 130 are driven to rotate downward, and thus the cleaning unit 160 of the cleaning robot 100 can be simultaneously contacted with the ceiling wall and the bottom wall of the duct 88.

Other Embodiments of the Invention

A remote controlled robot 200 for cleaning inner walls of ducts of a second embodiment in accordance with the present invention is distinguished from the robot 100 of the first embodiment in that the inner walls of ducts are cleaned by supplying highly compressed air onto the inner walls instead of contacting brushes 161-165 with the inner walls. Therefore, in describing the second embodiment of the present invention, detailed description of same or similar functions or structures of the first embodiment is omitted in order to clarify the gist of the second embodiment of the present invention.

Figure 9:
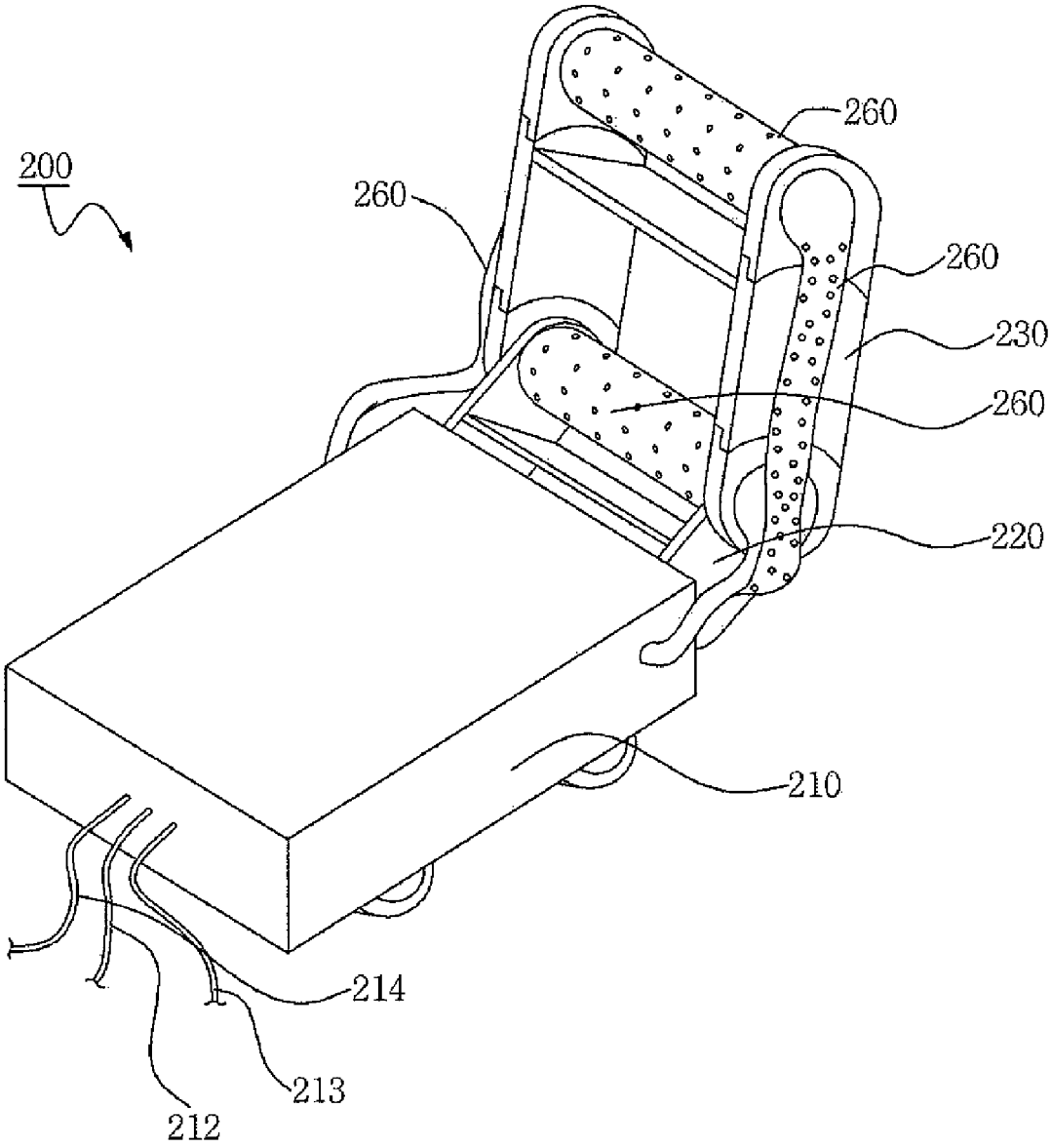
FIG. 9 is a perspective view illustrating a remote controlled robot for cleaning inner walls of a duct of a second embodiment in accordance with the present invention.

FIG. 9 is a perspective view illustrating a remote controlled robot for cleaning inner walls of a duct of a second embodiment in accordance with the present invention. As shown in FIG. 9, the cleaning robot 200 of the second embodiment of the present invention comprises: a cart 210 which moves inside of a duct 88 in any direction by remote control, a pair of first links 220 relatively rotatable to the cart 210 at front part of the cart 210, a pair of second links 230 relatively rotatable to the pair of the first links 220, a first driving unit (not shown) for driving the first links to relatively rotate to the cart 210, a second driving unit (not shown) for driving the second links 230 to relatively rotate to the first links 220 respectively, a cleaning means of air passage 260 along the second links 230 and along the upper area between the free ends of the second links 230 and along the bottom area between the connection ends of the second links 230 so as to supply compressed air onto the inner walls of duct 88.

The cart 210 includes power cables 212 and signal cables 213 similarly to the first embodiment, and further includes an air supplying tube 214 for supplying highly pressed air to the air passage 260 in the cart 210.

The air passage 260 is formed as rectangular around the second links 230 as shown in FIG. 9. A plurality of nozzles formed as holes or slits are formed on the air passage 260 as a rectangular shape, and thus compressed air is simultaneously supplied onto the four inner walls, i.e., ceiling wall, bottom wall and side walls. From this construction, in case that it is difficult to separate dusts from inner walls of ducts 88 by physical contact of brushes, the compressed air may efficiently separate dusts from the inner walls.

As the air passage 260 does not rotate, the second links 230 are formed as simple structure without installation of gears 164*a*, 165*a* and 169*a* therein. However, in order to more efficiently clean the inner walls of ducts 88, as described in the first embodiment, the air passage 260 can be installed to rotate selectively.

A remote controlled robot 300 for cleaning inner walls of ducts of a third embodiment in accordance with the present invention is distinguished from the robot 100 of the first embodiment in that the inner walls of ducts is cleaned by brushes to separate dusts stuck on inner walls of ducts 88 and also by suction means to remove the separated dusts from the inside of the ducts 88, so that the cleaning process of separating dusts from inner walls of ducts 88 and removing dusts from ducts 88 is realized at one time. Therefore, in describing the third embodiment of the present invention, detailed description of same or similar functions or structures of the first embodiment is omitted in order to clarify the gist of the second embodiment of the present invention.

Figure 10:
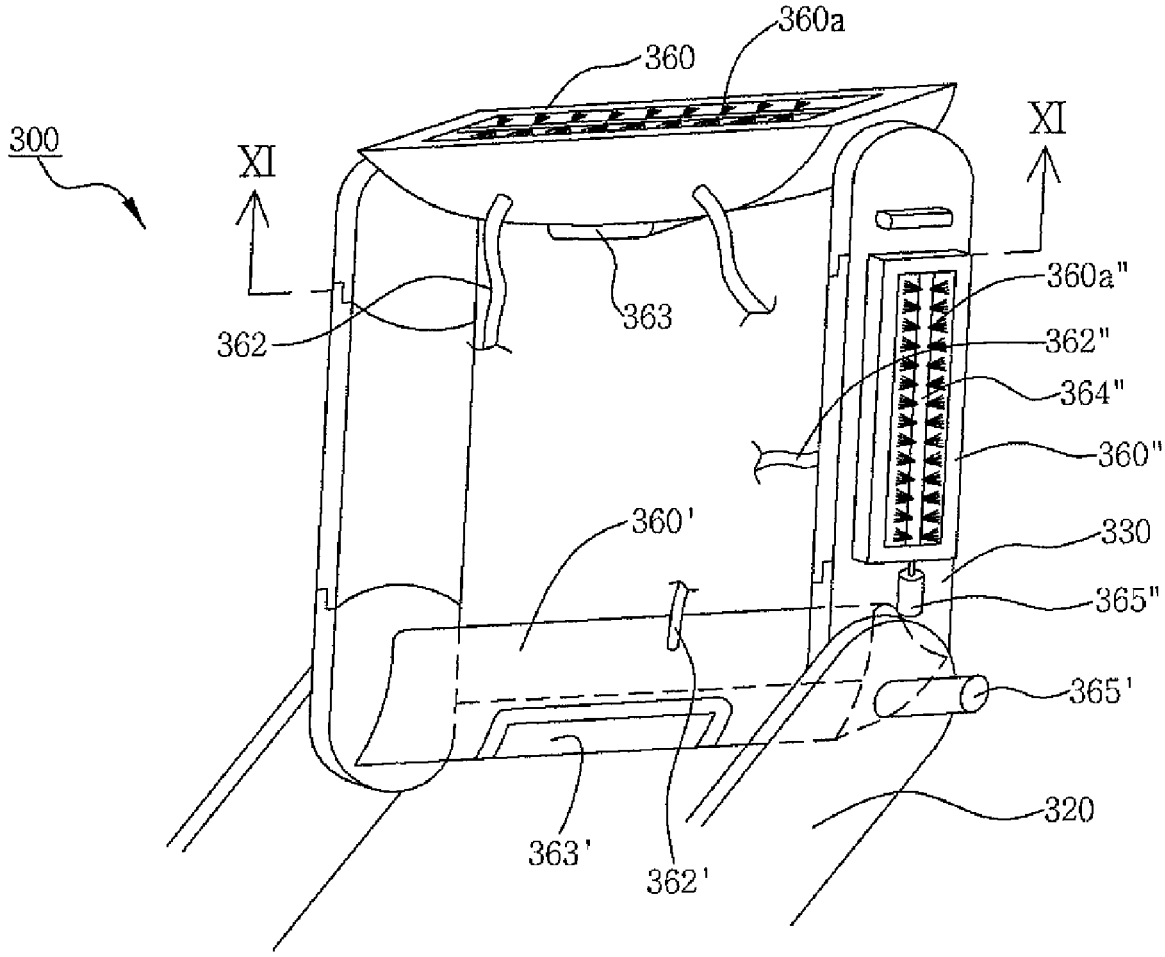
FIG. 10 is a perspective view illustrating a remote controlled robot for cleaning inner walls of duct of a third embodiment in accordance with the present invention.
Figure 11:
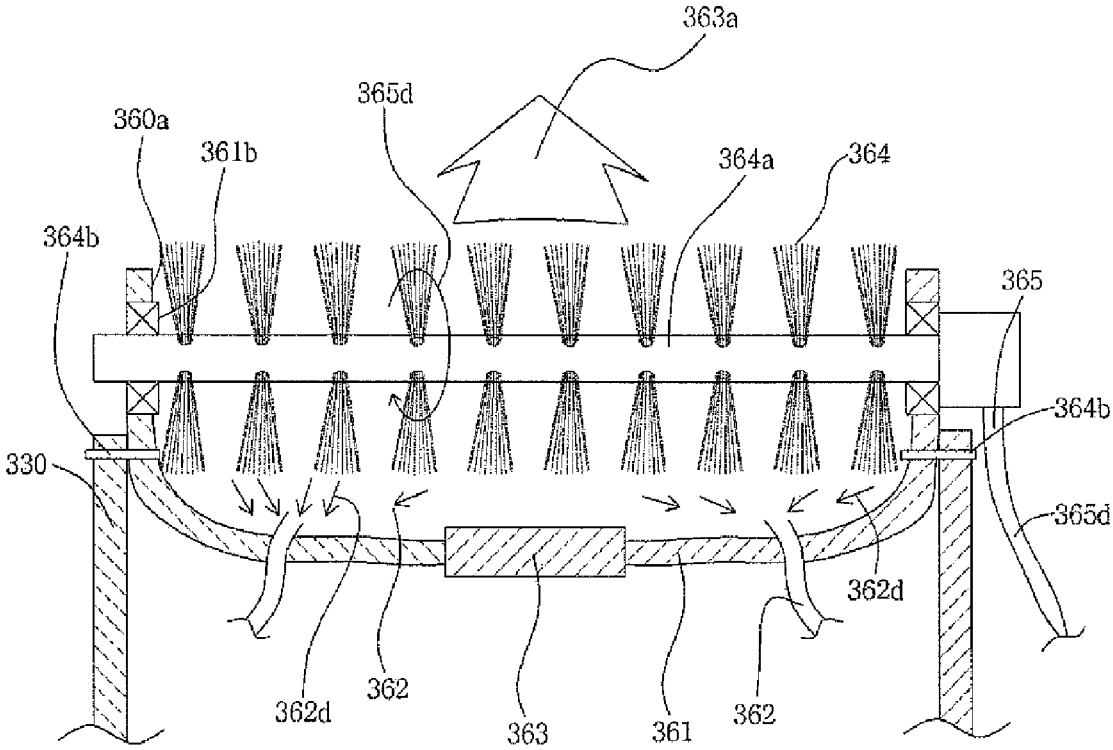
FIG. 11 is a cross sectional view by a cut line XI-XI of FIG. 10.

As shown in FIGS. 10 and 11, the cleaning robot 300 of the third embodiment of the present invention comprises: a cart (not shown) which moves inside of a duct 88 in any direction by remote control, a pair of first links 320 relatively rotatable to the cart at front part of the cart, a pair of second links 330 relatively rotatable to the pair of the first links 320, a first driving unit (not shown) for driving the first links to relatively rotate to the cart, a second driving unit (not shown) for driving the second links 330 to relatively rotate to the first links 320 respectively, a cleaning means 360, 360', 360" installed at both outer sides of the second links 330 and at the upper area between the free ends of the second links 330 and at the bottom area between the connection ends of the second links 330 for separating dusts from inner walls and collecting and exhausting the separated dusts to the outside of ducts 88.

The cart includes power cables 212 and signal cables 213 similarly to the first embodiment, and further includes a suction tube 362, 362', 362" for discharging the collected dusts to the outside of ducts 88.

The cleaning means includes a first cleaning means 360 at the upper area between the free ends of the second links 330 for cleaning ceiling wall of ducts 88, a second cleaning means 360' at the bottom area between the connection ends of the second links 330 for cleaning bottom wall of ducts 88, and a pair of third cleaning means 360" at both outer sides of the second links 330 for cleaning side walls of ducts 88. Although FIG. 10 shows the third cleaning means 360" are installed on the center area of the second links 330, the third cleaning means 360" can be installed to cover the whole area of the second links 330.

Herein, as illustrated in FIG. 11, the first cleaning means 360 includes a suction case 361 installed freely rotatable at the free ends of the second links 330, a suction tube 362 connecting the suction case 361 to the outside of ducts 88 for discharging dusts inside of ducts 88 therethrough, a balance weight 363 attached on the lower part of the suction case 361 so that the suction opening 360*a* naturally faces the upper direction, brushes 364 fixed along a rotating shaft 364*a* at the suction opening 360*a* driven to rotate, and a driving motor 365 to make brushes 364 rotate.

That is, as the rotating shaft 364*a* is rotatably supported by bearings 361*b* at the suction case 361, and as the suction case 361 is also rotatably supported by pins 364*b* at the free ends of the second links 330, the opening 360*a* of the suction case 361 faces the opposite direction to gravity, and further, the brushes 364 at the opening 360*a* can relatively rotate to the suction case 361. Similarly, the second cleaning unit 360' is constructed as the first cleaning unit 360 except that the balancing weight 363' is attached near the suction opening 360*a*' for letting the suction opening 360*a*' face downwards.

Under this construction of the cleaning robot 300, as the cleaning robot 300 moves with the both ends of second links 330 at the proximities of bottom wall and ceiling wall respectively, the first cleaning unit 360 constantly faces upwards due to the balance weight 363 and the second cleaning unit 360' constantly faces downwards due to the balance weight 363'. Further, when the cleaning robot 300 passes through the sloped region in ducts 88, the freely rotatable suction cases 361, 361' contact with the ceiling wall and the bottom wall respectively, and thus the suction openings 360*a*, 360*a*' can contact with the ceiling wall and the bottom wall face-to-face.

The cleaning robot 300 of the third embodiment has an advantageous effect that dusts can be separated and removed from ducts 88 at one time without spreading dusts into nearby by rotating brushes 364, 364" to separate dusts from inner wall and then by sucking and discharging dusts from the inside of dust to the outside.

Hereinafter, a remote controlled robot cleaning system 1 of the present invention is explained. In describing the remote controlled robot cleaning system, detailed description of function or structure which has already been described above is omitted in order to clarify the gist of the present invention.

Figure 12:
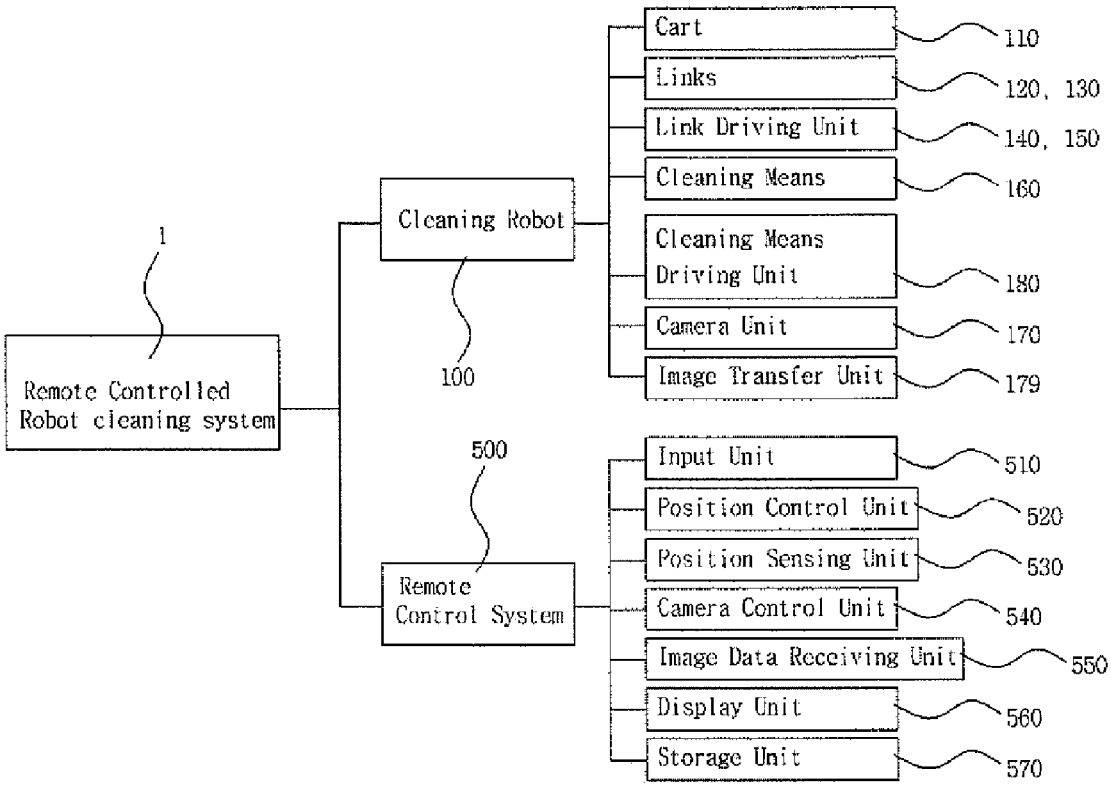
FIG. 12 is a block diagram of a remote controlled robot cleaning system using the remote controlled robot in FIG. 1.
Figure 13:
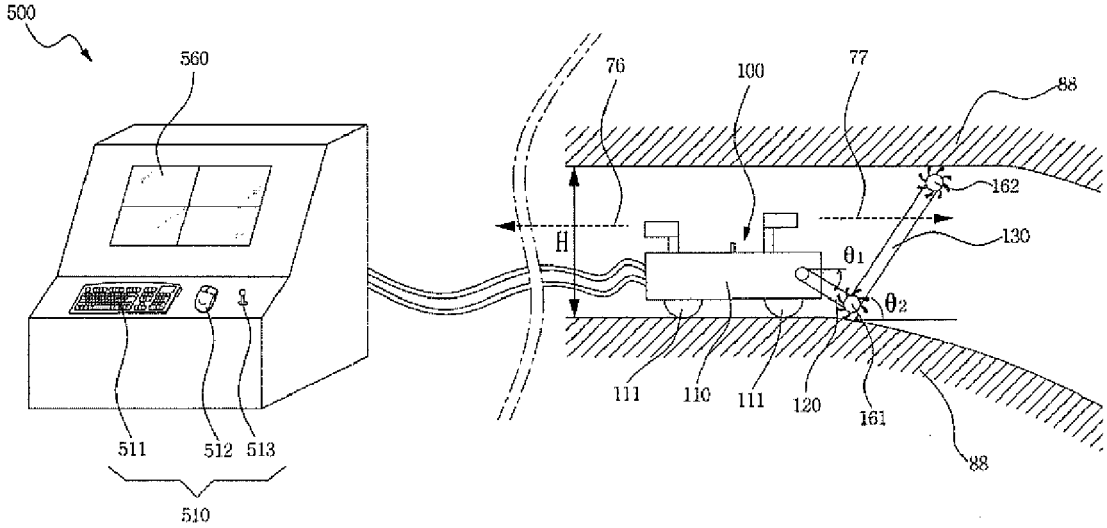
FIG. 13 is a schematic view of controlling the remote controlled robot by the remote controlled robot cleaning system.

As illustrated in FIGS. 12 and 13, the remote controlled robot cleaning system 1 of the present invention comprises: a cleaning robot 100 as shown in FIGS. 1 to 11 to move in ducts 88 and clean dusts inside of the ducts 88 by remote control, a remote control system 500 for controlling the cleaning robot to clean the inside of ducts 88.

The remote control system 500 includes an input unit 510 having a keyboard 511, a mouse 512 and a joystick 513 for inputting control signal by an operator, a position control unit 520 for controlling the movement of the cart 110 and the rotation of links 120, 130 based on the signal input by the operator, a position sensing unit 530 for sensing the location of the cleaning robot 100 in the duct layout by inversely calculating the travelled distance from the initial starting location, a camera control unit 540 for controlling the cameras 171-174 to photograph front, rear and side views and capture the images thereof and selectively to rotate the cameras 171-174 in horizontal and vertical direction to view a targeted region, an image data receiving unit 550 for receiving the images captured by the cameras 171-174, a display unit for displaying information necessary to proceed with the cleaning process and the images received from the cameras 171-174 in the four divided screens 561-564 in real-time or after the whole cleaning process, and a storage unit 570 for storing image data captured from the cameras 171-174 or storing the screen image displayed by the display unit 550 in storage medium such as hard disk, CD, DVD, USB memory and video tape, etc.

Figure 14:
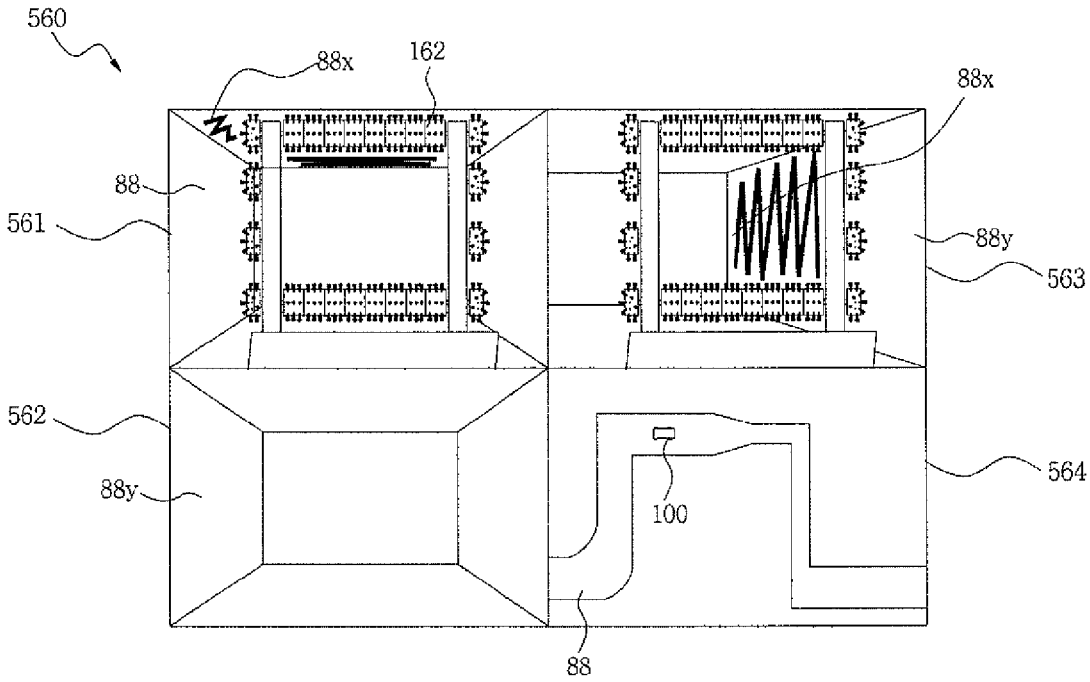
FIG. 14 is a screen displayed by the display unit in FIG. 13.

Herein, as illustrated in FIG. 14, the display unit 560 displays the photographed views captured and transferred from the plurality of cameras 171-174 in real-time. That is, the front views of the cleaning robot 100 photographed by the front camera 171 are being displayed in the first divided screen 561 located at left-upper part of the display unit 560 in real-time, the rear views of the cleaning robot 100 photographed by the rear camera 172 are being displayed in the second divided screen 562 located at the left-lower part of the display unit 560 in real-time, the side view being cleaned by side brushes 163 is being displayed from either the left camera 173 or the right camera 174 in the third divided screen 563 located at left-lower part of the display unit 560 in real-time.

Therefore, an operator in charge of cleaning ducts 88 can check from the second divided screen 562 whether the cleaned surface 88y through which the cleaning robot passed is completely cleaned, and also the operator can check from the first divided screen 561 how dirty inner surface 88*x* before cleaning is and thus recognize in advance the specific region where the cleaning robot 100 should handle more carefully. Further, the operator can visually and directly check the cleaning state in real-time by viewing the side/top/bottom region in the third divided screen at which is being cleaned by the cleaning means 160. Herein, the images shown in the third divided screen is being captured by the rotatable cameras 173, 174. Thus, the operator can control the cleaning robot 100 to completely clean the whole inner wall of a duct corner to corner.

Also, the remote control system 500 is capable of sensing the position of the cleaning robot 100 in the dark and complex ducts 88 by the position sensing unit 530 through inversely calculating the movement distance of the cleaning robot 100 from the initial starting point, i.e., the inlet of the duct 88. Thus, as illustrated in FIG. 14, based on the sensed position of the cleaning robot 100, the display unit 560 displays the position of the cleaning robot 100 on the duct layout in the fourth divided screen 564, whereby the operator can easily catch the position of the cleaning robot 100 in the duct layout and also can control the movement of the cleaning robot 100 more easily and safely.

Also, the storage unit 570 of the remote control system 500 stores the images captured by cameras 171-174 during cleaning process in storage medium such as hard disk, CD, DVD, memory and video tape. At the same time, the storage unit 570 also stores the images which are being displayed by the display unit 560 in storage medium so that anyone can check the same screen as an operator views during cleaning process. Therefore, when cleaning process is finished, an operator can check the cleaning state of interior of ducts 88 again based on the image data stored in the storage medium, and if any place is not cleaned enough, the operator may make up the concentrative cleaning of the ducts 88 again.

Most of all, the image data stored in the storage medium includes images before cleaning (including still and moving images) captured by the front camera 171 as well as the images after cleaning (including still and moving images) captured by the rear camera 172, the owner of a building does not need to check the cleaning state during the cleaning process, and rather the owner can easily check the cleaning state more minutely and scrupulously by viewing the stored images captured by cameras 171-174.

Industrial Applicability

As the present invention can be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

That is, although the embodiments described above exemplifies the a electric motor 144, 154, 184 is applied to drive the second links to relatively rotate to the first links, to drive the first links to relatively rotate to the cart, and to drive brushes as cleaning unit to rotate, it is obvious that the scope of the present invention defined in claims includes all other means to drive them to rotate such as air motor, hydraulic cylinder or electric cylinder.

Further, the embodiments described above exemplifies that the motors 154, 184 to drive the second links to relatively rotate to the first links and to drive brushes to rotate are installed at links, in order to prevent the weight of cleaning robot biased to the front, the motors 154, 184 can be installed in the cart. Also, the driving motor 184 to rotate brushes can drive to rotate any one of the gears 182, 183 which are engaged with one another within the scope of the claims.

What is claimed is:

1. A remote controlled robot for cleaning the inner walls of a duct, which comprises:

a cart movable in the duct by remote control;

at least one first link pivotally connected to the cart, which is rotatable relative to the cart;

a first driving unit to drive the first link to rotate relative to the cart;

a pair of second links pivotally connected to the first link, which are rotatable relative to the first link the pair of second links being spaced-apart from each other;

a second driving unit to drive the second link to rotate relative to the first link;

a plurality of cleaning brushes for separating dusts from the inner walls of the duct, the cleaning brushes including bottom brushes rotatably installed at one end of and between the pair of second links, ceiling brushes rotatably installed at the other end of and between the pair of second links, and a plurality of side brushes rotatably arrayed along the outside of each of the pair of the second links; and a plurality of spur gears engaged with one another and arrayed along each of the second links so that the plurality of cleaning brushes are driven to rotate;

wherein the cleaning brushes can simultaneously be in contact with the ceiling wall, the bottom wall and the side wall of the duct by rotating the first link and the second links, while the cart moves a path including upward/downward sloping region along the duct.

2. The remote controlled robot as claimed in claim 1, further comprising:

at least one front camera facing forwards from the cart through the space between the pair of the second links; and at least one illuminator to face the front region of the cart.

3. The remote controlled robot as claimed in claim 1, wherein the second links are formed by combining at least two separable links in longitudinal direction, whereby the length of each second link is controlled by the number of the separable links or by the length of the separable links.

* * * * *